United States Patent [19]

Matsuzaki

[11] Patent Number: 4,783,646

[45] Date of Patent: Nov. 8, 1988

[54] STOLEN ARTICLE DETECTION TAG SHEET, AND METHOD FOR MANUFACTURING THE SAME

[75] Inventor: Kazuhiro Matsuzaki, Yokohama, Japan

[73] Assignee: Kabushiki Kaisha Toshiba, Kawasaki, Japan

[21] Appl. No.: 21,701

[22] Filed: Mar. 4, 1987

[30] Foreign Application Priority Data

Mar. 7, 1986 [JP] Japan ..... 61-49911
Aug. 12, 1986 [JP] Japan ..... 61-189010

[51] Int. Cl.[4] ..... G08B 13/18
[52] U.S. Cl. ..... 340/572
[58] Field of Search ..... 340/572

[56] References Cited

U.S. PATENT DOCUMENTS 3,711,848 1/1973 Martens ..... 340/572
4,063,229 12/1977 Welsh et al. ..... 340/572
4,302,846 11/1981 Stephen et al. ..... 340/572
4,413,254 11/1983 Pinneo et al. ..... 340/572

*Primary Examiner*—Glen R. Swann, III
*Attorney, Agent, or Firm*—Finnegan, Henderson, Farabow, Garrett and Dunner

[57] ABSTRACT

A first conductive pattern is printed on a first insulating film and includes a transmitting antenna, a receiving antenna, an inductor section, and a diode connected in parallel with the inductor section. The inductor and parallelly-connected diode form an LC resonator of the first conductive pattern. A second insulating film, having first and second through-holes for exposing two end portions of the inductor section, is fixedly attached to the first insulating film and a third insulating film and is used as a spacer between them. A second conductive pattern is printed on the third insulating film spanning the first second through-holes, and a conductive member housed in the first through hole joins the first and second conductive patterns. A semiconductor chip of a Schottky diode is used as the diode and housed in the second through-hole in direct contact with the first and second conductive patterns.

16 Claims, 2 Drawing Sheets

FIG. 1A
(PRIOR ART)
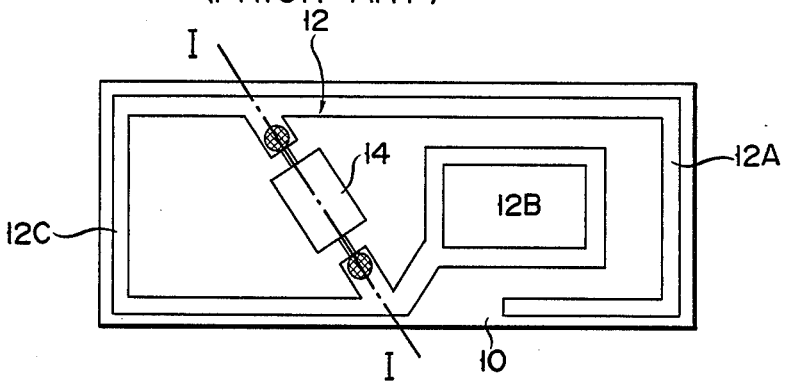
FIG. 1B
(PRIOR ART)
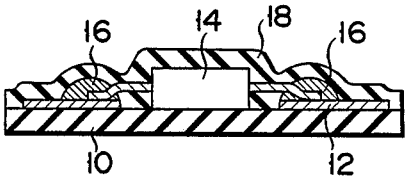
FIG. 1C
(PRIOR ART)
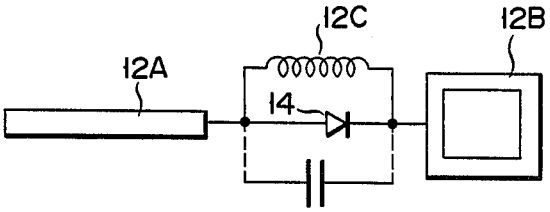
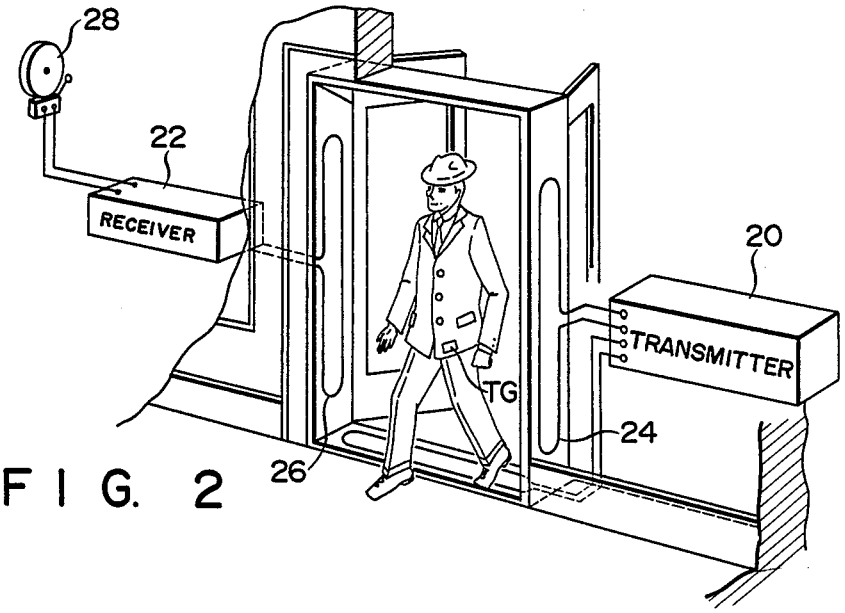
FIG. 2

STOLEN ARTICLE DETECTION TAG SHEET, AND METHOD FOR MANUFACTURING THE SAME

BACKGROUND OF THE INVENTION

The present invention relates to a stolen article detection tag sheet attached to an article in, e.g., a department store, and a method for manufacturing the same.

FIG. 1A is a plan view of a conventional stolen article detection tag sheet, and FIG. 1B is a sectional view of the tag sheet taken along the line I—I of FIG. 1A. The tag sheet has conductive pattern 12 formed on insulating sheet 10 of, e.g., a polyimide resin. Pattern 12 is obtained by selectively etching a metal film, e.g., a copper foil, formed to cover the entire surface of sheet 10. Pattern 12 has sections 12A, 12B, and 12C serving as a receiving antenna, a transmitting antenna, and an inductor, respectively. Semiconductor diode device 14 is connected to two ends of portion 12C through solder 16. Diode device 14 and portion 12C constitute an LC resonator. This tag sheet is electrically equivalent to the circuit shown in FIG. 1C. Pattern 12 and diode device 14 are covered with, e.g., resin insulating film 18 by means of thermo compression bonding and are protected by it.

In a shoplifting prevention system of a shop such as a department store, a detector shown in FIG. 2 is used together with a tag sheet in order to find a stolen article. Printing is performed on the tag sheet and the printed tag sheet is attached to an article as, e.g., a price tag or an article tag. All articles are displayed in this state for sale in the store. When a customer selects a desired article and pays for it at a cashier counter, a tag sheet on the article is removed from the article by the cashier. The detector is installed at an appropriate exit of the shop. When someone puts on, e.g., a jacket with attached tag sheet TG and is departing through the exit, as shown in FIG. 2, the detector sets off an alarm, indicating that shoplifting has occurred. The detector comprises transmitter 20 for continuously generating a high-frequency signal of about, e.g., 1.15 GHz, receiver 22 for detecting a high-frequency signal of 2.3 GHz, and transmitting and receiving antennas 24 and 26, e.g., opposing each other sandwiching an exit doorway. A signal generated by transmitter 20 is supplied to transmitting antenna 24 and is radiated from antenna 24 as a radio wave. The radio wave is input to tag sheet TG attached to the article passing the exit doorway. Receiving antenna 26 supplies a high-frequency signal corresponding to the input radio wave to receiver 22. Receiver 22 turns on an alarm in response to a 2.3-GHz high-frequency signal. The transmitting/receiving frequency of tag sheet TG is predetermined by specifying the constant of the LC resonator, i.e., the product of the inductance of section 12C and the parasitic capacitance across the two ends of diode device 14.

However, the conventional tag sheet has the following problems.

First, polyimide is used as a material for insulating sheet 10 and, during a process of forming conductive pattern 12, a copper foil is formed on the entire surface of one major surface of sheet 10 and then selectively removed by etching. Polyimide and copper foil are relatively expensive, and a manufacturing process including etching is comparatively complex. Therefore, a tag sheet of this type requires high material and manufacturing costs and is not suitable for mass production.

Second, mold-packaged diode device 14 is fixed on insulating sheet 10. Because of this, it is difficult to manufacture a thin tag sheet which is inherently needed for the application. Since diode device 14 is located on part of the surface of sheet 10, after device 14 is covered, the tag sheet cannot have a flat surface. Thus, the surface of the tag sheet is not suitable for printing, e.g., an article name on it.

Third, diode device 14 is connected to conductive pattern 12 through solder 16 over insulating sheet 10. Connection by means of a solder can easily be influenced by a fluctuation in the manufacturing process, and a good connection state cannot often be stably obtained.

SUMMARY OF THE INVENTION

It is a first object of the present invention to provide a stolen article detection tag sheet which has a resonator that operates stably, and a thin, flat surface shape, and which is inexpensive.

It is a second object of the present invention to provide a method for manufacturing a stolen article detection tag sheet, which can manufacture tag sheets as described above at low cost and on a large scale.

According to the first aspect of the present invention, there is provided a stolen article detection tag sheet comprising a first conductive pattern having a transmitting antenna section, a receiving antenna section, and an inductor section connected in series between the receiving and transmitting antenna sections, a semiconductor diode chip having a semiconductor substrate mounted on and electrically connected to a first portion of the inductor section and a Schottky barrier electrode formed on the top of the semiconductor substrate, a conductive member formed on a second portion of the inductor section, a second conductive pattern formed in contact with the conductive member and the Schottky barrier electrode, thereby causing the semiconductor diode chip and inductor section to constitute an LC resonator in cooperation with the second conductive pattern and conductive member, and an insulating body entirely covering the first and second conductive patterns, the conductive member, and the semiconductor diode chip.

According to the second aspect of the present invention,tthere is provided a method of manufacturing a stolen article detection tag sheets, comprising a first step of preparing first, second, and third insulating films; a second step of forming a first conductive pattern on the first insulating film, the first conductive pattern having a transmitting antenna section, a receiving antenna section, and an inductor section connected in series between the transmitting and receiving antennas; a third step of disposing a semiconductor diode chip and conductive member on respective first and second portions of the inductor section, the semiconductor diode chip and conductive member having substantially the same thickness as that of the second insulating film; a fourth step of forming first and second through-holes, used for housing the semiconductor diode chip and the conductive member disposed on the first conductive pattern, respectively, in the second insulating film; a fifth step of forming a second conductive pattern, used for electrically connecting the semiconductor diode chip and said conductive member, on the third insulating film; and a sixth step of fixedly attaching the first, second and third insulating films to each other, thereby causing the semiconductor diode chip and the inductor section to constitute an LC resonator in cooperation with the second conductive pattern and conductive member.

The tag sheet of the present invention uses the semiconductor diode chip in place of a mold-packaged diode device. The thickness of the semiconductor diode chip is significantly thinner than that of a mold-packaged diode device and thus allows an improvement in the thickness and flatness of a resultant tag sheet. The semiconductor diode chip is mounted on the first conductive pattern, and connected to the inductor section without solder. Thus, the tag sheet can operate stably.

According to the method of manufacturing the tag sheet according to the present invention, the second insulating film serves as a spacer between the first and second insulating films. Therefore the tag sheet can have a flat surface. On the other hand, the conductive pattern may formed by printing. Printing processing sections is easier than etching and less time-consuming when a plurality of tag sheets are continuously manufactured. As a result, tag sheets can be manufactured at a low cost on a large scale. In addition, the amount of conductive material used for printing is smaller than that used by etching wherein an excessive amount of conductive material is selectively removed in order to leave a conductive pattern. Therefore, the material cost for the tag sheet can be reduced.

BRIEF DESCRIPTION OF THE DRAWINGS

FIG. 1A is a plan view of a conventional stolen article detection tag sheet;

FIG. 1B is a sectional view of the tag sheet taken along the line I—I of FIG. 1A;

FIG. 1C is an equivalent circuit diagram of the tag sheet shown in FIGS. 1A and 1B;

FIG. 2 shows a detector used for shoplifting prevention together with the tag sheet;

DETAILED DESCRIPTION OF THE PREFERRED EMBODIMENT

Figure 3A:
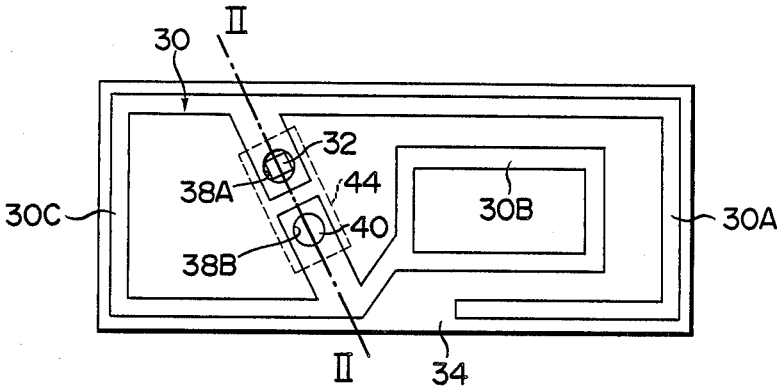
FIG. 3A is a plan view of a stolen article detection tag sheet according to an embodiment of the present invention.
Figure 3B:
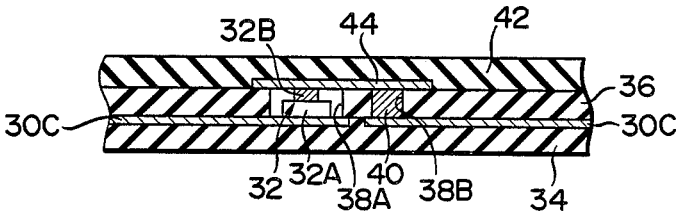
FIG. 3B is a sectional view of the tag sheet taken along the line II—II of FIG. 3A.

A tag sheet according to an embodiment of the present invention will be described with reference to FIGS. 3A and 3B. FIG. 3A is a plan view of the tag sheet, and FIG. 3B is a sectional view of the tag sheet taken along the line II—II of FIG. 3A. The tag sheet is electrically equivalent to the conventional circuit shown in FIG. 1C and has conductive pattern 30 and Schottky diode 32. Pattern 30 is formed on first polyester film 34 having a thickness of 150 μm by printing, e.g., an Ag paste which includes argentum and epoxy resin. Sections 30A, 30B, and 30C of pattern 30 serve as a transmitting antenna, a receiving antenna, and an inductor, respectively, in a similar manner to the conventional case. Schottky diode 32 is formed as a semiconductor diode chip having a thickness of about 200 μm and has semiconductor substrate or die 32A and cathode electrode 32B formed in Schottky contact with the upper surface of substrate 32A. Diode 32 is fixed by a die mount to one end of section 30C of pattern 30, so that this end of section 30C serves as an anode electrode of diode 32. The tag sheet has two through-holes 38A and 38B, and second polyester film 36 having a thickness substantially the same as that of the chip of diode 32. Second polyester film 36 covers pattern 30 and is stacked on first polyester film 34. Films 34 and 36 are bonded by adhesion. When films 34 and 36 are adhered, through-hole 38A houses diode chip 32 and through-hole 38B exposes the other end of section 30C. Conductive layer 40 is formed in contact with section 30C, by depositing an Ag paste as a conductive adhesion material, in through-hole 38B. The tag sheet further has third polyester film 42 having a thickness of 150 μm and conductive pattern 44 formed for wiring Schottky diode 32. Pattern 44 is formed by printing an Ag paste on polyester film 42. Film 42 is stacked on film 36 and is bonded to it by adhesion. When films 42 and 36 are adhered, pattern 44 electrically connects conductive layer 40 to cathode electrode 32B of diode 32.

Thus, Schottky diode 32 and secion 30C are connected in parallel with each other to serve as an LC resonator. The frequency of the transmitting/receiving radio wave of the tag sheet is determined by the product of the parasitic capacitance across the two ends of diode 32 and the inductance of section 30C. For example, when a radio wave of 1.15 GHz is received and a radio wave of 2.3 GHz is transmitted, inductance L and capacitance C of the following values are used, e.g., $L=2.4$ nH and $C=8$ pF. In this embodiment, polyester films 34, 36, and 42 are used as an insulating covering material. Polyester transmits radio waves well and is less expensive than polyimide. As a result, the material cost of the tag sheet is less than in a conventional case.

Schottky diode 32 of this embodiment comprises a diode chip before mold packaging and is significantly thinner than a mold-packaged diode device. This allows a reduction of the thickness of the tag sheet.

In this embodiment, polyester film 36 is used as a spacer inserted between polyester films 34 and 42, and Schottky diode 32 is housed in through-hole 38A in film 36. Therefore, when films 34, 36 and 42 are bonded, the flatness of the tag sheet surface will not suffer due to the thickness of diode 32. In other words, the tag sheet has a surface flatness suitable for printing an article name or the like on it.

Schottky diode 32 is fixed to conductive pattern 30 by a die mount. Hence, the resonator can operate more stably than in a case wherein diode 32 is fixed by soldering, thus increasing reliability of the tag sheet.

The tag sheet of this embodiment has a structure suitable for manufacture by automation, as will be described later.

Figure 4:
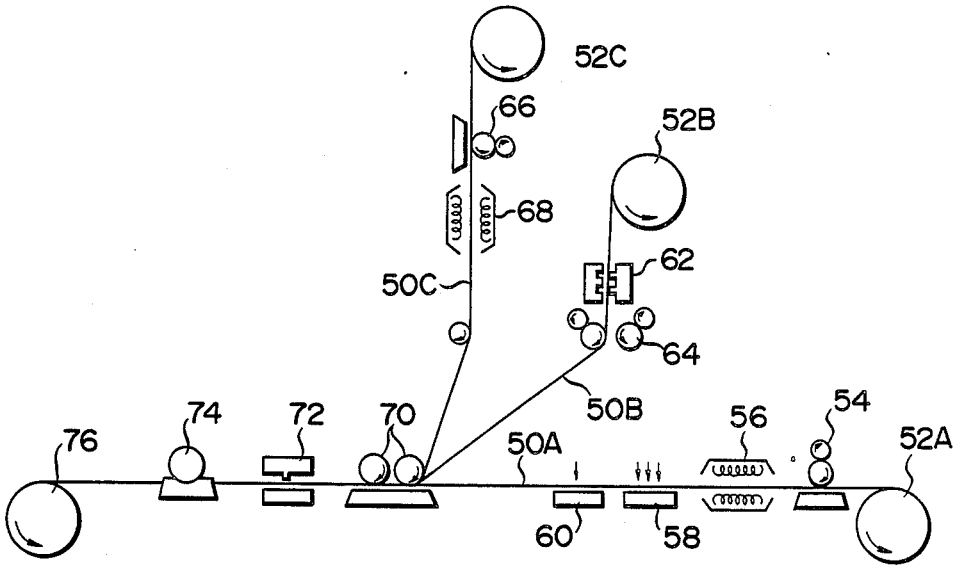
FIG. 4 is for explaining the manufacturing process of the tag sheet shown in FIGS. 3A and 3B and shows the processing sections of an apparatus for manufacturing the same.

FIG. 4 shows a processing section of an apparatus for manufacturing the tag sheets having the structure as shown in FIGS. 3A and 3B. Referring to FIG. 4, the drive mechanism and control unit of the manufacturing apparatus are omitted so as not to complicate the drawing. In this manufacturing apparatus, belt-like polyester films 50A, 50B, and 50C are used as base materials of films 34, 36, and 42, respectively, of a plurality of tag sheets and are continuously supplied from rollers 52A, 52B, and 52C, respectively. The manufacturing apparatus includes a first processing section for processing film 50A, a second processing section for processing film 50B, and third processing section for processing film 50C. The first processing section has printing rollers 54, oven 56, stamping zone 58, and mount zone 60. The second processing section has punching section 62 and transfer rollers 64. The third processing section has printing rollers 66 and oven 68. The manufacturing apparatus also includes a fourth processing section for processing films 50A, 50B, and 50C. The fourth processing section has heat/press rollers 70 for processing films 50A, 50B, and 50C, punching section 72, slitter section 74, and product roller 76.

Polyester film 50A is supplied from roller 52A to printing rollers 54. Rollers 54 offset-print an Ag paste pattern at a predetermined position on film 50A. The Ag paste pattern is moved from rollers 54 to oven 56 together with film 50A and baked in oven 56 at 100° to 150° C. for 3 to 5 minutes, and conductive pattern 30 having a resistivity of 1Ω-cm or less is thus formed. Conductive pattern 30 is moved from oven 56 to stamping zone 58 together with film 50A. At zone 58, an Ag paste which includes argentum and epoxy resin is coated as a conductive adhesive on the two end portions of inductor section 30C of pattern 30 and is semi-cured at a temperature of about 80° C. Film 50A is supplied from zone 58 to mount zone 60. At zone 60, a semiconductor diode chip, i.e., Schottky diode 32 is fixed at one of the predetermined adhesive coating portions of pattern 30.

Meanwhile, polyester film 50B is supplied from roller 52B to punching section 62. Section 62 forms holes at two predetermined portions of film 50B by punching, thus forming through-holes 38A and 38B. Film 50B is supplied from section 62 to transfer rollers 64. At rollers 64, an insulating adhesive is uniformly coated on the two surfaces of film 50B.

Polyester film 50C is supplied from roller 52C to printing rollers 66. Rollers 66 offset-print an Ag paste pattern at a predetermined portion on film 50C. The Ag paste pattern is moved from rollers 66 to oven 68 together with polyester film 50C and baked in oven 68 at 100° to 150° C. for 3 to 5 minutes, and conductive pattern 44 having a specific resistivity of 1Ω·cm or less is thus formed.

Polyester films 50A, 50B, and 50C are supplied from mount zone 60, transfer rollers 64, and oven 68, respectively, to heat/press rollers 70, and are stacked, as shown in FIG. 4. Rollers 70 fixedly attach films 50A, 50B, and 50C to each other by thermo compression bonding and bake the conductive adhesive on conductive pattern 30 until it changes from a semi- to completely-cured state. In this processing, the conductive adhesive constitutes conductive layer 40 in through-hole 38B, the cathode of Schottky diode 32 is electrically connected to the one end of inductor section 30C through conductive pattern 44 and layer 40, and the anode thereof is electrically connected to the other end of inductor section 30C. As a result, a tag sheet as a stacked member is obtained.

A single processing by each section mentioned above can be performed for, as a unit, a plurality of tag sheets arranged in a widthwise dirction perpendicular to the extending direction of films 50A, 50B, and 50C. When this processing is repeatedly performed, a continuous strip of tag sheet units can be obtained. This continuous strip is supplied from heat/press rollers 70 to punching section 72, and is perforated between adjacent units. The continuous strip of the tag sheet units is supplied from punching section 72 to slitter section 74 and is cut into continuous strips of separated tag sheets in the extending direction. The continuous strips are supplied from punching section 72 to product roller 76 and are taken up.

In this manufacturing apparatus, conductive patterns 30 and 44 are formed by printing using the Ag paste. This reduces the processing time as compared to that of etching. Therefore, manufacturing costs for mass production of tag sheets are decreased.

Diode chip 32 is electrically connected to conductive pattern 30 not by soldering but by thermo compression bonding. Therefore, a good connecting state can be stably obtained.

In the manufacturing apparatus of this embodiment, conductive layer 40 in through-hole 38B is formed by coating simultaneously with the coating of the mount material for the diode chip. However, the conductive adhesive in through-hole 38B can be coated after second polyester film 50B is stacked on polyester film 50A. In this case, the stack position of third polyester film 50C is moved to a further downstream side.

On the other hand, the cathode electrode 32B of Schottky diode chip 32 can be of a multi-layered type. In this case, an Au layer, for example, is formed in Schottky contact with the substrate 32A in advance, and an Ag paste is coated on the Au layer and semi-cured to form an Ag paste layer.

Diode chip 32 with the Ag paste layer is mounted on pattern 30C at zone 60. The Ag paste layer is completely cured at heat/press rollers 70.

What is claimed is:

1. A stolen article detection tag sheet comprising:

an insulating body having a through-hole section;

a first conductive pattern formed in said insulation body and including a transmitting antenna section, a receiving antenna section, and an inductor section connected in series between said receiving and transmitting antenna sections;

a semiconductor diode chip housed in a through-hole of said through-hole section and having a semiconductor substrate mounted on and electrically connected to a first portion of said inductor section of said conductive pattern and a Schottky barrier electrode formed on the top of said semiconductor substrate; and a wiring means including a conductive member formed on a second portion of said inductor section for connecting said Schottky barrier electrode to said conductive pattern, thereby causing said semiconductor diode chip and conductive pattern to constitute an LC resonator in cooperation with said wiring means.

2. A stolen article detection tag sheet according to claim 1, wherein said insulating body includes first, second and third insulating films, said second insulating film serving as said through-hole section and having first and second through-holes, and said first, second and third insulating films are fixedly attached to each other.

3. A stolen article detection tag sheet according to claim 2, wherein said semiconductor diode chip is housed in said first through-hole, and said conductive member is housed in said second through-hole.

4. A stolen article detection tag sheet according to claim 3, wherein said wiring means further has a second conductive pattern formed in contact with said conductive member and said Schottky barrier electrode.

5. A stolen article detection tag sheet according to claim 4, wherein said first and second conductive patterns are respectively printed on said first and third insulating films.

6. A stolen article detection tag sheet according to claim 5, wherein said first, second and third insulating films are formed of polyester resin.

7. A stolen article detection tag sheet according to claim 6, wherein said first and second conductive patterns and conductive member are formed of a conductive adhesion material.

8. A stolen article detection tag sheet according to claim 7, wherein said conductive adhesion material is an argentum/epoxy resin series paste.

9. A stolen article detection tag sheet according to claim 1, wherein said insulating body is formed of polyester resin.

10. A stolen article detection tag sheet according to claim 1, wherein said through-hole section includes a second through-hole, and said conductive member is formed of a conductive adhesion material deposited in said second through-hole.

11. A method of manufacturing a stolen article detection tag sheet, comprising:

a first step of preparing first, second, and third insulating films;

a second step of forming a first conductive pattern on said first insulating film, said first conductive pattern having a transmitting antenna section, a receiving antenna section, and an inductor section connected in series between said transmitting and receiving antennas;

a third step of disposing a semiconductor diode chip and conductive member on respective first and second portions of said inductor section, said semiconductor chip and conductive member having substantially the same thickness as that of said second insulating film;

a fourth step of forming first and second through holes, used for housing said semiconductor diode chip and said conductive member disposed on said first conductive pattern, respectively, in said second insulating film;

a fifth step of forming a second conductive pattern, used for electrically connecting said semiconductor diode chip and said conductive member, on said third insulating film; and a sixth step of fixedly attaching said first, second and third insulating films to each other, thereby causing said semiconductor diode chip and said inductor section to constitute an LC resonator in cooperation with said second conductive pattern and conductive member.

12. A method according to claim 11, wherein said second step includes a first substep of printing a conductive paste pattern on said first insulating film, and a second substep of baking the conductive paste pattern after said first substep.

13. A method according to claim 12, wherein said third step includes a third substep of coating and semi-curing a conductive adhesion material on said first and second portions of said inductor section and a fourth substep of fixing said semiconductor diode chip to the first portion of said inductor section after said third substep.

14. A method according to claim 13, wherein said fourth step includes a fifth substep of punching holes in said second insulating film.

15. A method according to claim 14, wherein said fifth step includes a sixth substep of printing a conductive paste pattern on said third insulating film, and a seventh substep of baking the conductive paste pattern after said sixth substep.

16. A method according to claim 15, wherein said sixth step includes an eighth substep of fixedly attaching said first, second, and third insulating films to each other by thermo compression bonding.

* * * * *